United States Patent [19]

Labedan et al.

[11] 4,028,209

[45] June 7, 1977

[54] ELECTROLYSIS CELL

[75] Inventors: Pierre Labedan, Crepieux La Pape; Robert Mugnier; Hubert Chavanel, both of Lyon, all of France

[73] Assignee: Rhone-Poulenc, Paris, France

[22] Filed: Sept. 24, 1976

[21] Appl. No.: 726,220

Related U.S. Application Data

[63] Continuation-in-part of Ser. No. 221,746, Jan. 28, 1972, abandoned.

[30] Foreign Application Priority Data

Feb. 2, 1971 France ..... 71.04345

[52] U.S. Cl. ..... 204/252; 204/266; 204/279

[51] Int. Cl.[2] ..... C25B 1/26; C25B 9/00

[58] Field of Search ..... 204/252, 266, 279

[56] References Cited

UNITED STATES PATENTS

| | | | |
|---|---|---|---|
| 323,731 | 8/1885 | Phillips | 277/211 |
| 494,402 | 3/1893 | Walsh | 277/211 X |
| 3,390,072 | 6/1968 | Wiseman | 204/266 |
| 3,591,483 | 7/1971 | Loftfield | 204/252 |
| 3,632,497 | 1/1972 | Leduc | 204/263 |

*Primary Examiner*—Arthur C. Prescott

[57] ABSTRACT

An electrolysis cell is provided comprising an anodic bottom, an anode assembly and a cathode assembly, whereby there is provided a hydraulic and electrically insulating gasket assembly between the cathode assembly and a support plate for the anodes, which gasket assembly eliminates the need for lead and asphalt coatings or concrete support troughs. The insulating gasket assembly comprises a rigid portion having an upper face and a lower face, each of thefaces being provided with at least one groove in which is placed a flexible gasket which protrudes above the face of said rigid portion, with said grooves being staggered opposite each other so that said rigid portion rests on the lower portion of the cell.

6 Claims, 3 Drawing Figures

ELECTROLYSIS CELL

BACKGROUND OF THE INVENTION

This application is a continuation-in-part of our copending application, Ser. No. 221,746, filed Jan. 28, 1972, now abandoned.

The present invention relates to a diaphragm cell for the electrolysis of aqueous solutions of alkali-metal halides, having a new anodic bottom and a new hydraulic and electrically insulating gasket.

In conventional diaphragm-type or membrane-type electrolysis cells, the anodic bottoms comprise anodes, generally of graphite, the lower parts of which are covered or coated by a layer of lead which keeps them in a fixed position and allows them to be fed with current from copper strips which are themselves sealed into the layer of lead. The anode assembly thus formed is thereafter placed in a concrete trough, on top of which anode assembly the cathode assembly rests. In order both to protect and to seal the anodic bottom, an asphalt layer is cast inside the concrete bottom so as to cover the lead and the lower parts of the graphite anodes, and thereby prevent the penetration of the very corrosive brines during electrolysis.

For some years, there has been a tendency for the graphite anodes to be replaced by metallic anodes, the surface of which is covered with a coating of precious metals. Their use has made it possible to introduce valuable improvements and simplifications in the construction of the anodic bottom. Thus, it has been possible to dispense with the use of lead and asphalt, which considerably lightens the weight of the cell.

U.S. Pat. No. 3,719,578, commonly owned, describes a new electrolysis cell wherein the anode assembly consists firstly of a support plate, generally of copper, which serves as a current feed and is externally sleeved with a thin foil or a metal or alloy which is corrosion resistant to the anodic medium, preferably the metal or alloy is of titanium, and secondly, of a battery of metallic anodes fixed to the support plate by bolts embedded directly in the latter. Thi anode assembly is placed in a cell trough of concrete or of a polyester laminate.

This design of the anode of said copending application had advantages with respect to weight, because of the absence of lead, graphite and asphalt, and achieved a simple method of fixing the anodes. However, the conventional design of the trough of concrete or polyester laminates used in this case has presented certain difficulties in actual use.

In effect, in order to avoid leakages of brine where the anodic supply lines pass through, it is necessary to be able to be assured of a perfect seal between the trough and the sleeved support plate. To achieve this, attempts have been made to cast a strip of polyester resin at the periphery of the corrosion-resistant metal sleeve of the support plate which provides the current feed. This solution did not prove satisfactory because it is practically impossible to achieve good adhesion of the polyester resin both to the concrete or polyester laminate trough and to the corrosion-resistant metal sleeve. This lack of adhesion, aggravated by heat shocks, is the cause of the leakages of the brine which cause the corrosion of the copper outside the cell, in the area where the copper is not sleeved.

The present invention makes it possible to avoid these disadvantages by replacing the conventional type of trough by a new flat bottom, consisting of metal or polyester laminate, which is electrically insulated from the cathode assembly by a new gasket assembly which also prevents the leakage of liquids, namely, the corrosive brines.

The foregoing objects of the present invention are achieved by the present invention. Other objects and advantages will be apparent to those skilled in the art from the present description, taken in conjunction with the appended drawings, in which.

BRIEF SUMMARY OF THE INVENTION

Figure 1:
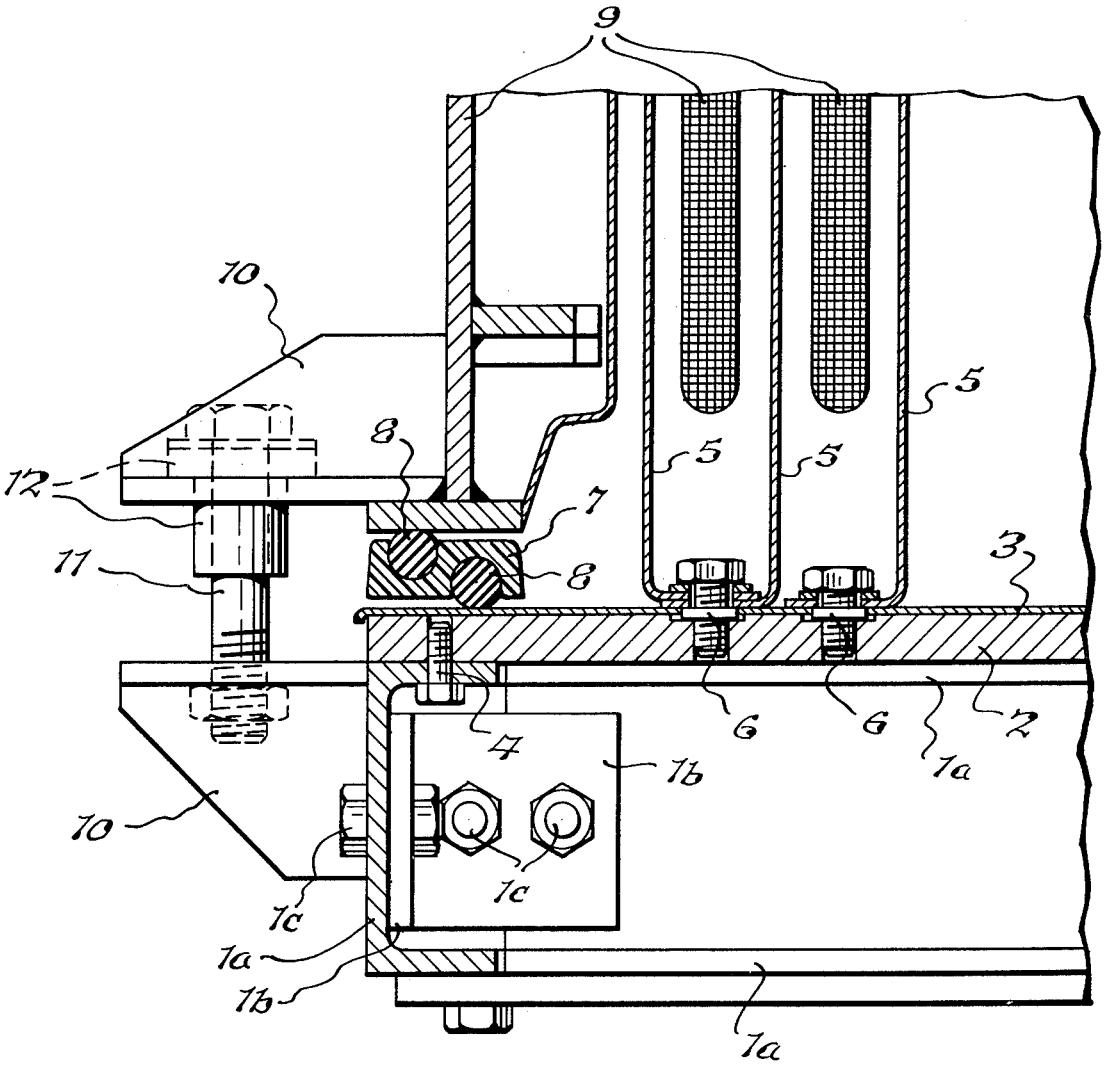
FIG. 1 is a partial cross-section of a cell of the invention, without its cover, with its anodic bottom, its cathode and anode assemblies and the gasket assembly which characterizes the present invention.

The present invention provides a cell for the electrolysis of aqueous solutions of alkali metal halides comprising an anodic bottom, an anode assembly and a cathode assembly, characterized in that the anodic bottom comprises a profile frame having an upper face forming the bottom of the cell, a support plate for the anodes located on the upper face of the frame and covering the said face, and a thin foil of corrosion-resistant metal sleeving the support plate, and in which a hydraulic and electrically insulating gasket assembly is placed between the cathode assembly and the thin foil of corrosion-resistant metal, over the periphery of the said foil, the gasket assembly comprising a rigid part having an upper face and a lower face, each of the faces being provided with at least one groove in which is placed a flexible, desirably toroid, gasket, the rigid part and the flexible gaskets consisting of a corrosion-resistant material and at least the rigid part of the flexible gaskets consisting of a material which is also electrically insulating.

The profiles of which the cell frame consists can be commercially available metal profiles or polyester laminate profiles which can contain a reinforcement so as to increase the rigidity. The support plate, preferably of copper, which provides the current feed, completely covers the frame, which is advantageous for general leakproofness and avoids the disadvantages described above. This support plate, sleeved over its upper part with a thin layer of corrosion-resistant metal, is additionally protected through the fact that the edges of the sleeve are folded over the periphery of the plate.

The metal anodes are preferably fixed to this support plate by means of bolts in accordance with the subject matter of said commonly owned U.S. Pat. No. 3,719,578. This plate also plays the role of a support for the cathode assembly.

The gasket assembly of the invention rests on the periphery of the corrosion-resistant metal sleeve. The rigid part of the gasket assembly preferably consists of an electrically insulating corrosion resistant organic plastic, such as a polyester, desirably in the form of a laminate, but can consist of any other corrosion-resistant and sufficiently rigid material. The flexible, preferably toroid, gasket components consist of a corrosion-resistant and sufficiently flexible material, such as, for example, rubber. Apart from corrosion-resistance, the gasket assembly must possess electrical insulating properties. For this purpose, the material forming the rigid part of the gasket assembly and desirably the material of which the flexible gasket components consist must be a good electrical insulator. This new gasket assembly fulfills a double function. It makes it possible to achieve complete leakproofness, avoiding leakages of brine and achieves complete electrical insulating between the cathode and the anode, thus preventing possible short-circuits. This gasket assembly also avoids the use of leakproofing mastics usually employed, which have the disadvantage of fouling the diaphragms.

The cathode assembly is thereafter deposited on the anodic bottom/laminate gasket assembly thus produced. In principle, the clamping of the gasket under the action of merely the weight of the cathode assembly and the cover of the cell suffices to ensure complete leakproofness. For safety, a supplementary device for clamping by means of threaded, insulated or insulating, rods can be provided, allowing the anodic and cathodic groups to be firmly fixed together. Another advantage of this construction is that it is possible to preassemble the cell assembly outside the electrolysis area, which facilitates installing the cell and makes it possible to save considerable time in assembly and dismantling.

The anodic bottom which forms the subject of the invention is much lighter than a conventional concrete bottom, which facilitates handling operations. The anode assembly has the very considerable advantage of possessing a very long working life.

The polyester laminates from the cell frame profiles may be produced or the rigid parts of the gasket assembly are produced may be polyester reinforced with glass fibers or laminates produced by adhering sheets of polyester materials.

The corrosion-resistant metal which provides the sleeving over the support plate is desirably of a metal or alloy which is chemically resistant to the brines commonly used in electrolysis cells. Such metals as titanium, tantalum and their alloys or precious metals including the metals of the platinum group may be employed.

The flexible portions of the gasket assembly, which is preferably of toroidal shape, is desirably produced of material having good electrical resistance as well as flexibility. Natural rubber, synthetic rubbers, neoprene, and ethylene-propylene copolymer elastomers may be employed for this purpose.

DESCRIPTION OF EMBODIMENT OF THE INVENTION

The description which follows and is one illustration of the invention, will allow the invention to be better understood without, however, limiting it. The description relates to the appended FIGS. of drawings.

The metal bottom consists of a frame of commercially available profiles 1*a* , assembled by bolting. The corner irons 1*b* for fixing the transverse girders are attached to the latter by bolts 1*c*. A cooper support plate 2, which provides a current feed, and sleeve on its upper part by a thin titanium foil 3 of which the ends are folded over the lateral edges of the copper support plate, is fixed over the entire upper face of this bottom. The copper support plate 2 is fixed to the metal profile frame at the lower part of the plate by means of bolts 4. The metal anodes 5 are connected to the copper support plate 2 which provides the current feed by means of fixing bolts 6.

A special gasket member 7 of polyester laminate, equipped with two oppositely positioned grooves, as shown in the drawings, inside which are placed toroid rubber gaskets 8, rests against the entire periphery of the titanium sleeving foil 3 covering the copper plate 2. The toroidal gaskets are of generally circular cross-section and by themselves are doughnut-shaped, like that of a torus. The gasket member 7 can also be provided with several grooves on each of its faces, allowing the number of toroid gaskets to be varied.

The cathode block 9, which under the influence of its weight allows the gasket member 7 to be clamped, is now placed on top of the anode assembly and gasket member. A supplementary clamping device which allows the anode and cathode assemblies to be firmly fixed together is made up of the anchoring clamps 10, placed over the anodic bottom and cathode assembly and tightened by bolts 11, electrical insulation being achieved by means of insulating polyester rings 12.

Figure 2:
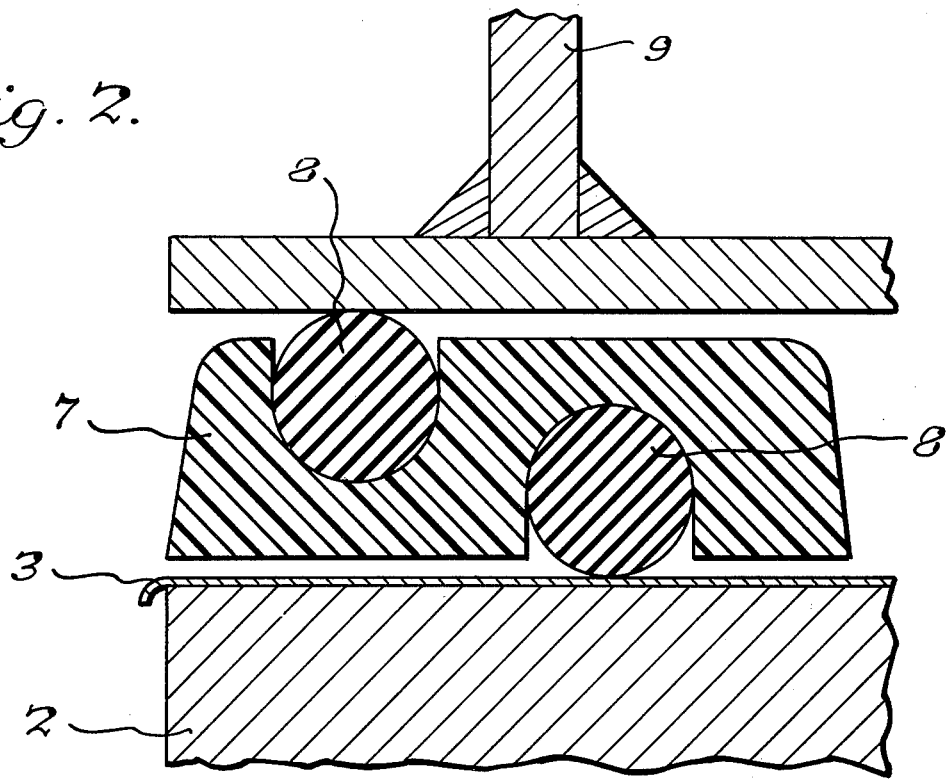
FIG. 2 is an enlarged cross-section of the gasket assembly before compression, with the adjacent cell components.

As shown in particular detail in FIG. 2, the gasket assembly, prior to being subjected to the weight of the cathode block 9, has its flexible rubber toroidal members 8 uncompressed. As shown in that figure, the gasket assembly is suspended between the cathode block 9 and the titanium foil 3. The rigid polyester laminate component 7 is not in contact with either of the cathode blocks 9 or the titanium foil 3. The two toroidal rubber members 8 are shown staggered on opposite sides of the gasket assembly.

Figure 3:
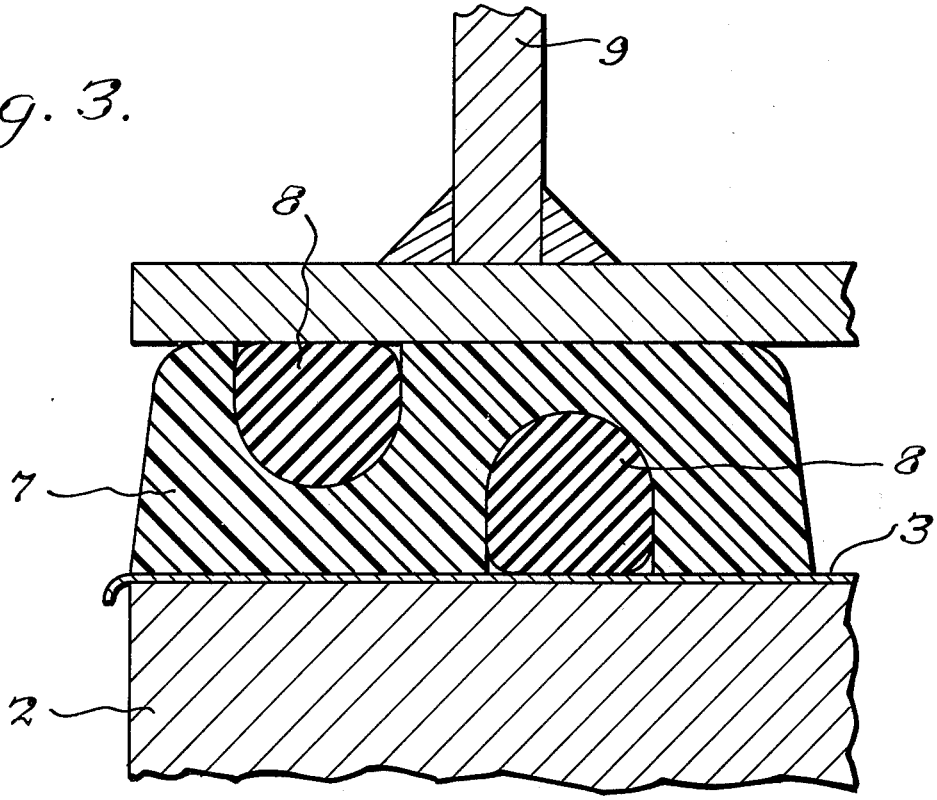
FIG. 3 is analogous to FIG. 2, but with the gasket assembly compressed by the adjacent cell components.

As shown in FIG. 3, when the gasket assembly is compressed between the cathode block 9 and the titanium foil 3 by the weight of the cathode block, the gasket assembly is brought into contact with the cathode block 9 and the titanium foil 3 by the weight of the cathode block, the gasket assembly is brought into contact with the cathode block 9 and the titanium foil 3, and the flexible toroidal rubber members 8 are compressed to form a tight seal with the adjacent surfaces, as shown in the drawing. The weight of the cathode block 9 is borne by the polyester laminate component 7 of the gasket assembly, with said laminate component surfaces being in contact with the adjacent surfaces of the block 9 and foil 3, while the liquid seals are provided primarily by the compressed flexible toroidal rubber members 8.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A cell of the diaphragm type for the electrolysis of aqueous solutions of alkali metal halides comprising an anodic bottom, an anode assembly and a cathode assembly, said anodic bottom comprising a profile frame having an upper face forming the bottom of the cell, a support plate for the anodes located on the upper face of the frame and covering the said face, and a foil of corrosion-resistant and electrically-conductive metal sleeving the support plate, and characterized in that a multiple-component, hydraulic and electrically insulating gasket assembly is placed between the cathode assembly and the foil of corrosion-resistant and electrically-conductive metal, over the periphery of the said foil, said multiple-component, hydraulic and electrically insulating gasket assembly comprising a non-deformable part having an upper face ad a lower face, each of the faces being provided with at least one groove in which is placed a non-permanently deformable flexible gasket, each of which protrudes above the face of said non-deformable part, said grooves being staggered opposite each other so that said non-deformable part rests on said foil of corrosion resistant, electrically-conductive metal, the non-deformable part and the non-permanently deformable flexible gaskets consisting of a corrosion-resistant material and which is also electrically insulating.

2. A cell acccording to claim 1 in which the non-deformable part of the gasket assembly consists of an electrically insulating, corrosion resistant organic plastic.

3. A cell according to claim 1 in which the non-deformable part of the gasket assembly consists of polyester laminate.

4. A cell according to claim 1 in which the non-permanently deformable flexible gaskets consist of rubber.

5. A cell according to claim 1 in which the upper and lower faces of the non-deformable part of the gasket each have a groove in which the non-permanently deformable flexible gasket is placed.

6. A cell of the diaphragm type for the electrolysis of aqueous solutions of alkali metal halides comprising an anodic bottom, an anode assembly and a cathode assembly, said anodic bottom comprising a profile frame having an upper face forming the bottom of the cell, a supporting plate for the anodes located on the upper face of the frame and covering the said face, and a foil of corrosion-resistant and electrically-conductive metal sleeving the support plate, and characterized in that a multiple-component, hydraulic and electrically insulating gasket assembly is placed between the cathode assembly and the foil of corrosion-resistant and electrically-conductive metal, over the periphery of the said foil, said multiple-component, hydraulic and electrically insulating gasket assembly comprising a non-deformable part of rigid corrosion-resistant polyester laminate having an upper face and a lower face, each of the faces being provided with at least one groove in which is placed a non-permanently deformable flexible gasket of rubber of toroidal configuration, each of which protrudes above the face of said non-deformable part, said grooves being staggered opposite each other so that said non-deformable part rests on said foil corrosion-resistant, electrically-conductive metal, and the cathode assembly resting on said gasket assembly, the non-deformable part and the non-permanently deformable flexible gaskets being corrosion-resistant and electrically insulating.

* * * * *

UNITED STATES PATENT AND TRADEMARK OFFICE

CERTIFICATE OF CORRECTION

PATENT NO. : 4,028,209

DATED : June 7, 1977

INVENTOR(S) : Pierre Labedan et al.

It is certified that error appears in the above-identified patent and that said Letters Patent are hereby corrected as shown below:

Column 1, line 42, delete "Thi" and replace with -- This --.

Column 4, line 67, delete "ad" and replace with -- and --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*